US005957432A

United States Patent [19]

Ostrobrod

[11] Patent Number: 5,957,432

[45] Date of Patent: Sep. 28, 1999

[54] SAFETY APPARATUS FOR HORIZONTAL LIFELINE

[76] Inventor: Meyer Ostrobrod, 2070 Bennett Rd., Philadelphia, Pa. 19116

[21] Appl. No.: 08/956,879

[22] Filed: Oct. 23, 1997

[51] Int. Cl.[6] ..... B66D 3/10

[52] U.S. Cl. ..... 254/368; 254/375; 254/903

[58] Field of Search ..... 254/368, 903, 254/223, 365, 366, 375

[56] References Cited

U.S. PATENT DOCUMENTS

| | | | |
|---|---|---|---|
| 625,974 | 5/1899 | Hansen . | |
| 1,028,770 | 6/1912 | Moser | 254/368 |
| 1,950,289 | 3/1934 | Benson | 254/107 |
| 2,506,705 | 5/1950 | Coffing | 254/368 |
| 2,529,617 | 11/1950 | Kunkel | 29/267 |
| 2,586,048 | 2/1952 | Hyatt | 254/368 |
| 2,956,778 | 10/1960 | Weide et al. | 254/903 |
| 3,574,342 | 4/1971 | Berns | 254/79 |
| 4,293,121 | 10/1981 | Wallin | 254/370 |
| 4,367,993 | 1/1983 | Meigs | 254/223 |
| 4,483,517 | 11/1984 | Cavalieri | 254/254 |
| 4,664,357 | 5/1987 | Nishimura | 254/903 |
| 5,083,350 | 1/1992 | Sandreid | 24/134 |
| 5,332,071 | 7/1994 | Duncan | 188/371 |
| 5,368,281 | 11/1994 | Skyba | 254/223 |
| 5,458,214 | 10/1995 | Olson et al. | 182/18 |
| 5,598,900 | 2/1997 | O'Rourke | 182/3 |

OTHER PUBLICATIONS

Fujii Denko Brochure, No. 221 (1993).

*Primary Examiner*—Katherine A. Matecki
*Attorney, Agent, or Firm*—Norman E. Lehrer

[57] ABSTRACT

A safety apparatus is capable of tensioning a horizontal lifeline while providing an adjustable shock absorber and a gauge or indicator for indicating the amount of tension on the lifeline. A housing is adapted to be secured to an anchor point through an anchoring line. The free end of a horizontal lifeline passes over a pulley within the housing and around a number of rollers which are adapted to maintain the lifeline in secure contact with the pulley. A lever is utilized to rotate the pulley in order to tension the lifeline. The lever, however, is interconnected to the pulley through an adjustable disk brake which can be preset to a desired force. When the tension on the lifeline reaches its desired level, the brake slips and the lever can freely rotate. A second series of disk brakes connected to the pulley function as a shock absorber. In the event of a fall, the initial force on the horizontal lifeline exceeds the braking force of the shock absorber brakes and the pulley can rotate through a limited number of turns. Eventually, however, the shock absorber brake slows the fall and eventually stops the same. The amount of tension on the shock absorber brake can also be adjusted to thereby control the amount of shock being absorbed. An additional brake mechanism prevents the lifeline from freely being drawn from the housing in the event of a complete failure of the mechanism thereof.

10 Claims, 4 Drawing Sheets

SAFETY APPARATUS FOR HORIZONTAL LIFELINE

TECHNICAL FIELD

The present invention is directed toward a safety apparatus and more particularly toward a safety apparatus which forms part of a horizontal lifeline system.

BACKGROUND ART

Horizontal lifelines have been employed for many years to provide fall protection for workers on elevated structures. In fact, such horizontal lifelines are required and have been mandated by safety rules and regulations in many jurisdictions. Such lifelines normally consist of a rope or cable suspended between two structures such as the vertical beams of a building or the like which may be 10, 20 or even 100 feet apart. A safety harness or safety belt is worn by a worker and a lanyard connected to the harness or belt attaches to the horizontal lifeline or cable. The end of the lanyard may include either a loop which can freely move along the length of the lifeline or it may include a pulley or the like that rolls along the line. This allows the worker to move freely along the length of the lifeline to accomplish his intended tasks. In the event that the worker losses his footing or otherwise falls, the horizontal lifeline, through the lanyard and harness or safety belt will arrest the fall and prevent the worker from suffering injury. The use of such a lifeline is described, for example, in U.S. Pat. Nos. 5,332,071; 5,458,214 and 5,598,900.

In order to function properly, the horizontal lifeline must be sufficiently taut so that the worker's lanyard can easily move across the same and so that the lifeline can function as a steadying rail for the worker, if necessary. However, when the lifeline is sufficiently taut that the same assumes a linear or substantial linear configuration, the resistance force magnitude required to effectively withstand the load impact of a falling worker becomes theoretically exceedingly large. In the event of a fall, the construction worker ordinarily generates many times his weight in the impact force exerted by the lanyard against the cable or lifeline. Thus, the tension in the lifeline is critical since this determines the amount of sag in a lifeline which, in turn, determines the load amplification by which a vertical fall arrest force applied to the lifeline is multiplied by. Therefore, it is important to know the amount of tension applied to a lifeline. In fact, the amount of tension is frequently dictated by safety rules or regulations in many jurisdictions.

A winch or similar type device is frequently used to tension a horizontal lifeline when the same is in use. The lifeline is normally connected to one anchoring point and then passes through the winch. The winch, in turn, is connected through an anchoring line to the second anchor point. A winch-like device for tightening a horizontal lifeline is available through Fujii Denko of Japan and is described in their product brochure No. 221, the subject matter of which is incorporated by reference herein.

Because the amount of tension on the horizontal lifeline is critical and is mandated by regulation, it is important to know what that tension is and to adjust the tensioning device accordingly. This normally requires a separate tension indicator. Such devices may be placed in line with either the horizontal lifeline or the anchoring line and may be in the form of a tension gauge or the like.

It is also well known that shock absorbers in combination with horizontal lifelines are desirable to absorb the initial force placed on the anchoring devices of the lifeline. This enables controlled elongation of the lifeline under load to increase the sag angle and, therefore, reduce the amplification forces on the anchors. At the same time, this prevents shock to the fallen worker by allowing him to come to a more gradual stop in the event of a fall. Known types of shock absorbing devices are described, for example, in the three prior art patents referred to above.

Heretofore, no device has been available which accomplishes all of the functions described above. Although the shock absorber shown in U.S. Pat. No. 5,458,214 includes a tension indicating means therein for indicating the amount of tension on the lifeline, the device is somewhat complex and still lacks the additional features described above. There has, therefore, been a need for a safety apparatus for use with horizontal lifelines which combines the features of a tensioner, adjustable shock absorber and a gauge or indicator.

DISCLOSURE OF THE INVENTION

The present invention is designed to overcome the deficiencies of the prior art described above and provides a safety device or apparatus which is capable of tensioning a horizontal lifeline while providing an adjustable shock absorber and a gauge or indicator for indicating the amount of tension on the lifeline. The invention includes a housing which is adapted to be secured to an anchor point through an anchoring line. The free end of a horizontal lifeline passes over a pulley within the housing and around a number of rollers which are adapted to maintain the lifeline in secure contact with the pulley. A lever is utilized to rotate the pulley in order to tension the lifeline. The lever, however, is interconnected to the pulley through an adjustable disk brake which can be preset to a desired force. When the tension on the lifeline reaches its desired level, the brake slips and the lever can freely rotate.

A second series of disk brakes connected to the pulley function as a shock absorber. In the event of a fall, the initial force on the horizontal lifeline exceeds the braking force of the shock absorber brakes and the pulley can rotate through a limited number of turns. Eventually, however, the shock absorber brake slows the fall and eventually stops the same. The amount of tension on the shock absorber brake can also be adjusted to thereby control the amount of shock being absorbed. An additional brake mechanism prevents the lifeline from freely being drawn from the housing in the event of a complete failure of the mechanism thereof.

BRIEF DESCRIPTION OF THE DRAWINGS

For the purposes of illustrating the invention, there is shown in the accompanying drawings one form which is presently preferred; it being understood that the invention is not intended to be limited to the precise arrangements and instrumentalities shown.

BEST MODE FOR CARRYING OUT THE INVENTION

Figure 1:
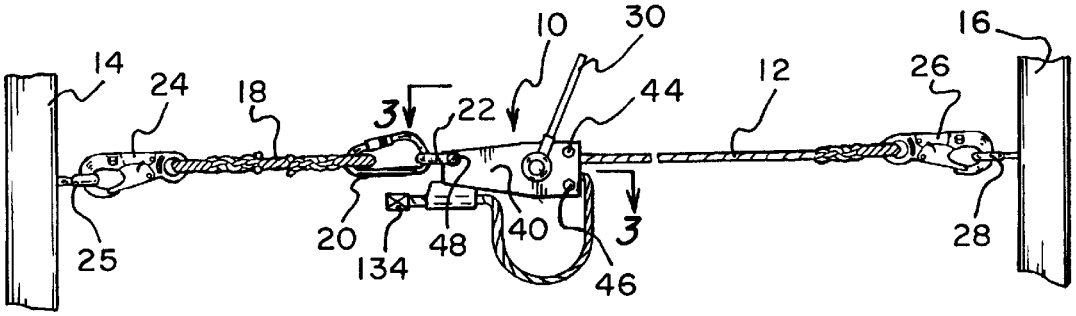
FIG. 1 is a schematic representation of a horizontal lifeline utilizing the safety apparatus of the present invention.

Referring now to the drawings in detail wherein like reference numerals have been used throughout the various figures to designate like elements, there is shown in FIG. 1 a safety device or apparatus constructed in accordance with the principles of the present invention and designated generally as 10. The safety device 10 is shown in use with a lifeline 12 comprised of an elongated rope which is suspended in a horizontal direction between two vertical supports 14 and 16. The vertical supports may be the vertical beams of a building under construction, supports for a bridge or elevated roadway or in substantially any location where a horizontal lifeline would be required.

The safety device 10 of the present invention is connected to the vertical support 14 through the use of an anchor line 18. One end of the anchor line is connected to a carabiner 20 which, in turn, is secured to an eye hook 22 connected to the safety assembly 10. The other end of the anchoring line 18 is connected to the vertical support 14 through the use of a spring biased hook 24 and an eyelet 25 connected to the vertical support 14. Similarly, the remote end of the horizontal lifeline 12 is connected to the vertical support 16 through the use of a spring biased hook 26 and an eyelet 28 connected to the vertical support 16. As should be readily apparent to those skilled in the art, the foregoing is by way of example only and numerous other types of connectors and interconnections can be used to support the horizontal lifeline 12 and the safety device 10.

The free end of the lifeline 12, that is, the end remote from the vertical support 16 passes through the safety device 10 in a manner to be described more fully hereinafter. As will also be described in more detail below, a lever 30 is provided on the safety device 10 for tensioning the lifeline 12.

Figure 2:
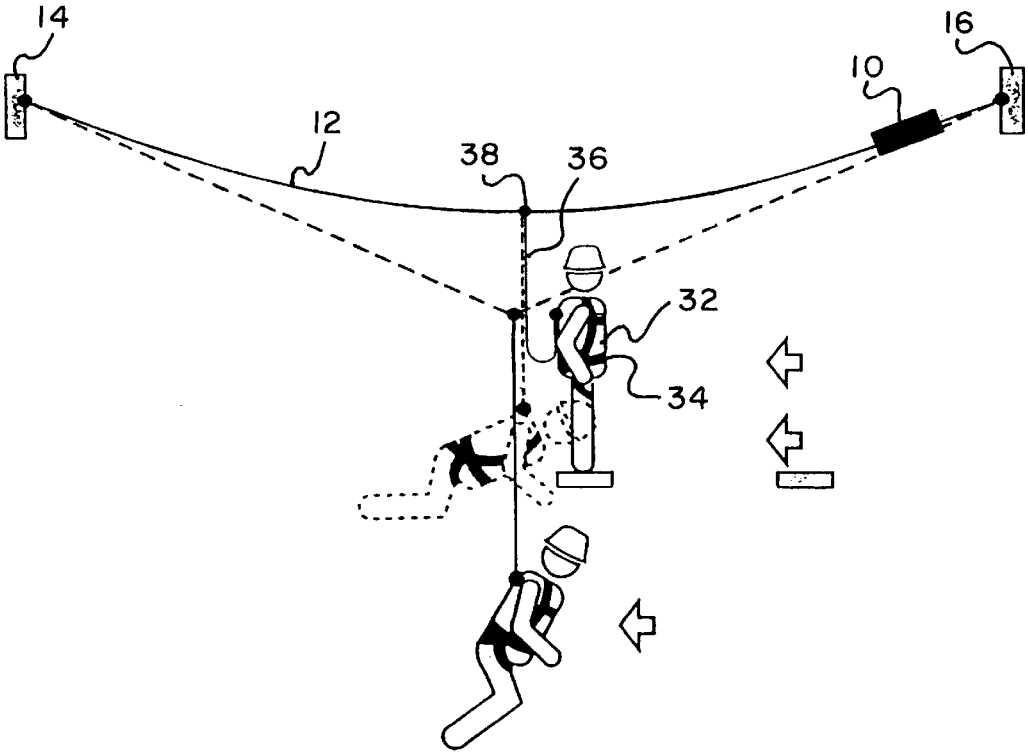
FIG. 2 is a schematic representation of the operation of a conventional horizontal lifeline.

The use of a lifeline 12 is, per se, well known in the art and is schematically illustrated in FIG. 2. A worker 32 wearing a harness 34 is connected to the lifeline 12 through the use of a lanyard 36. The free end 38 of the lanyard 36 may include a loop or pulley or the like that can freely travel along the length of the lifeline 12. This allows the worker to move along the length of the lifeline to perform whatever duties are required of him. Furthermore, depending on the length of the lanyard 36, the worker can also move to either side of the lifeline. In the event of a fall, however, the lifeline 12, through the lanyard 36 and harness 34, prevents the worker 32 from serious injury by arresting the descent. FIG. 2 also illustrates the force vectors on the lifeline 12 resulting from a fall of a worker 32 which are, per se, well known in the art.

The safety device 10 of the present invention is comprised essentially of a housing having a front wall 40 and a rear wall 42 interconnected but spaced apart from each other through the use of appropriate nuts and bolts such as shown at 44, 46 and 48 at the periphery thereof. Extending through the interior of the housing formed by the walls 40 and 42 is an axle 50 having a center portion 52, a forwardly extending portion 54, and a rearwardly extending portion 56. The axle 50 is mounted for rotation within the housing through the use of appropriate bearings 58 and 60 secured to openings formed in the front and rear walls 40 and 42, respectively.

A pulley wheel 62 is fixed to the central portion 52 of the axle 50 within the space between the front and rear walls 40 and 42. The pulley wheel 62 is secured to the axle 50 so as to positively rotate therewith.

As shown most clearly in FIGS. 5–9, the inner side walls of the pulley 62 are formed with a plurality of ribs such as shown at 64 and 66. The size and shape of these ribs 64 and 66 along with the dimensions of the pulley wheel 62 and the horizontal lifeline 12 provide a substantially positive gripping force on the lifeline 12. This essentially prevents any slippage between the lifeline 12 and the pulley wheel 62 when the lifeline passes around the pulley wheel. The importance of this will become more readily apparent hereinafter.

Figure 3:
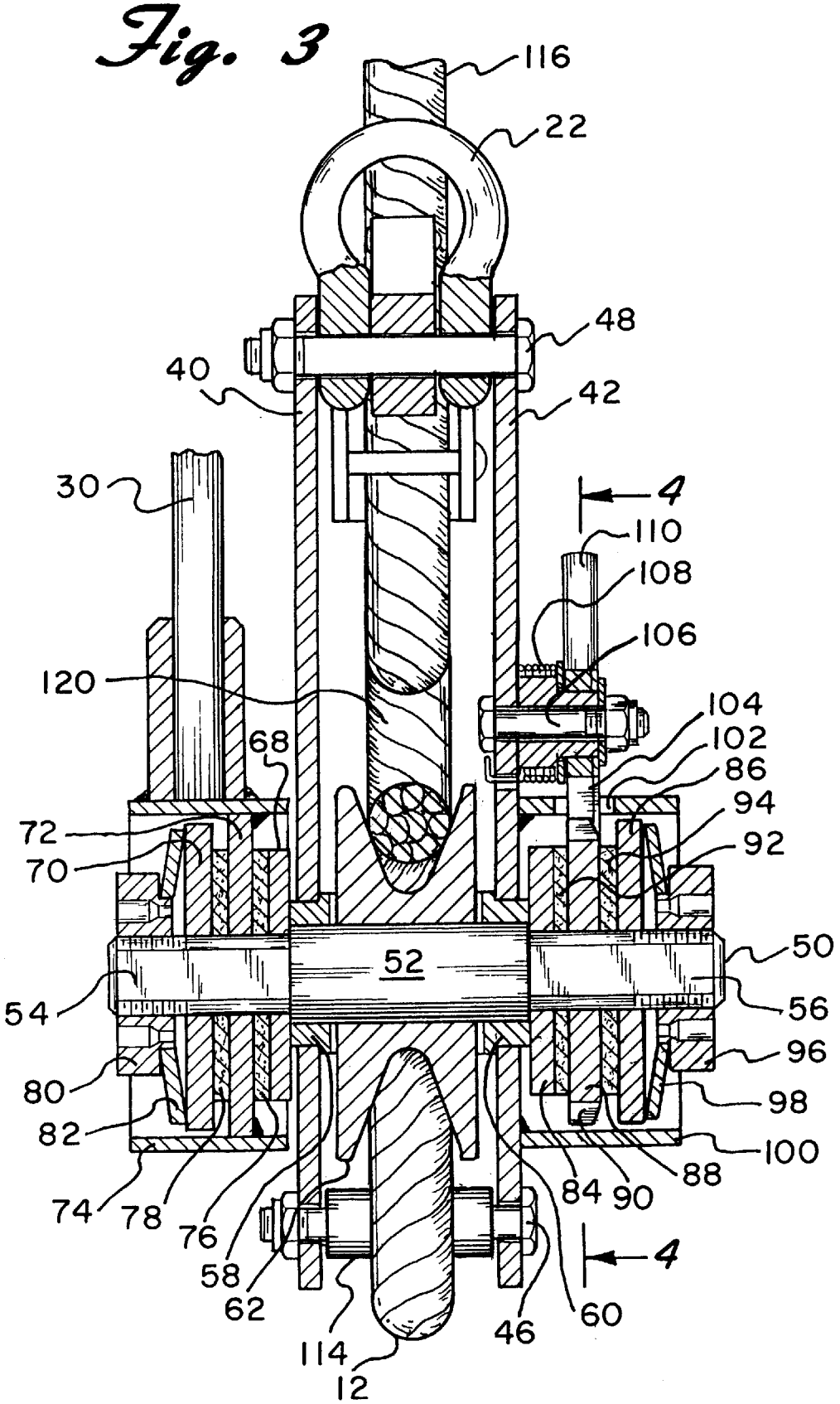
FIG. 3 is a cross sectional view taken through the line 3—3 of FIG. 1.

Referring now to FIG. 3, the forwardly extending end 54 of the axle 50 is fitted with a pair of circular disks 68 and 70. The disks 68 and 70 are keyed to the shaft end 54 so as to positively rotate therewith. Located between the disks 68 and 70 is an additional disk 72 which is free to rotate about the end 54 of the axle 50. The outer edge of disk 72 is welded or otherwise secured to a cylindrical member 74 which is likewise free to rotate about the axle 50 in unity with the disk 72. The lever 30, also shown in FIG. 1, is secured to the outer surface of the cylinder 74 and extends outwardly so as to be easily grasped by a worker so that the same can be rotated about the axis of the axle 50 along with the cylindrical member 74 and the disk 72.

Located between the disk 68 and the disk 72 is a friction brake pad 76. A similar friction brake pad 78 is located between the disk 70 and the disk 72. A nut 80 is threaded onto the end of the shaft end 54 of the axle 50 and can be used to tighten a spring washer 82 against the disk 70 to compress the series of disks 68, 70 and 72 against the friction brakes pads 76 and 78.

As a result of the sandwich arrangement of the various disks and brake pads, it can be seen that with the nut 80 tightened on to the shaft end 54, the spring washer 82 compresses the various disks and brake pads together.

Accordingly, when lever 30 is rotated, a turning force is applied through cylinder 74 and disk 72 to the disks 68 and 70 through the brake pads 76 and 78. Thus, with no resistance force or with some predetermined resistance force on the pulley 62, rotation of the lever 30 will result in rotation of the pulley 62. However, at some predetermined torquing force placed on the lever 30, the force applied by the brake pads 76 and 78 on the disk 72 will be exceeded and the disk 72 will merely slip and rotate freely relative to the disks 68 and 70. This predetermined force will, of course, be equal to the desired tension on the horizontal lifeline 12 which will be preventing further rotation of the pulley 62.

The amount of the force applied to lever 30 before the disk 72 begins to slip can be adjusted by tightening or loosening the nut 80. This adjusts the amount of spring tension on the sandwich comprised of the disks 68, 70 and 72 and the brake pads 76 and 78 as a result of the spring washer 82. It is, therefore, possible to include a dial with indicia therein on the outer face of the nut 80 relative to the end face of the shaft end 54 whereby the angular position between the nut 80 and the shaft end 54 can indicate a certain predetermined tension force or a series of different forces with different markings.

Figure 4:
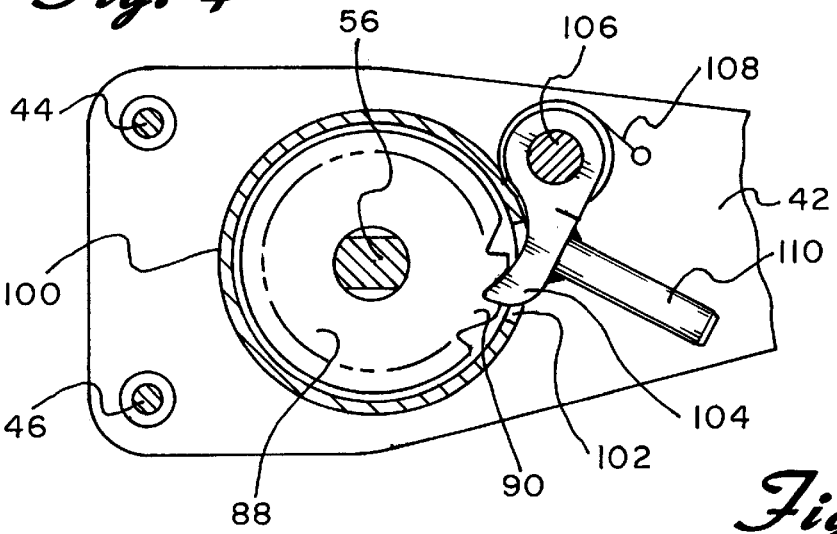
FIG. 4 is a cross sectional view taken through the line 4—4 of FIG. 3.
Figure 7:
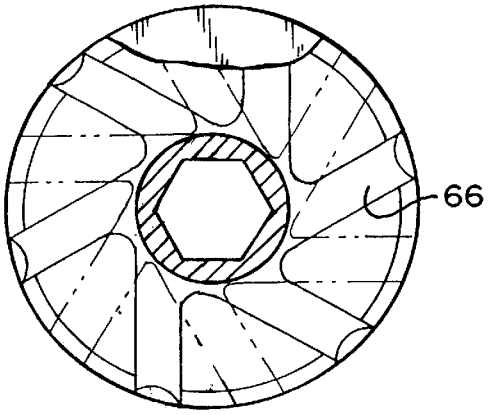
FIG. 7 is a view similar to the view of FIG. 6 further illustrating the pulley utilized with the present invention.
Figure 5:
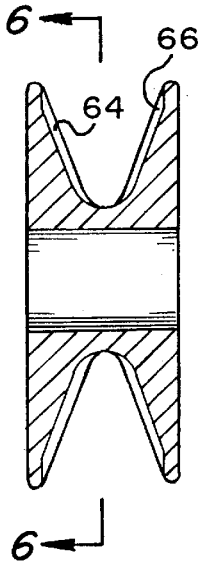
FIG. 5 is a cross sectional view of the pulley utilized with the present invention.
Figure 6:
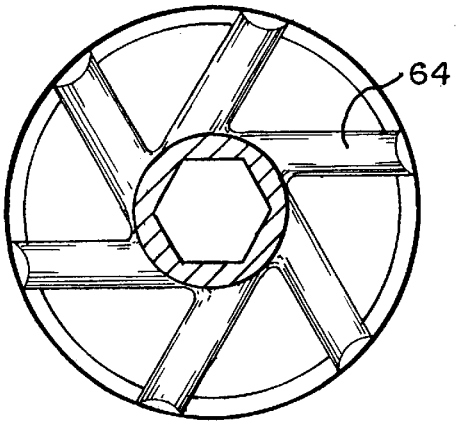
FIG. 6 is a cross sectional view taken through the line 6—6 of FIG. 5.

The other side of the safety device 10, that is the right side as viewed in FIG. 3, has a similar braking system. Disks 84 and 86 are secured to the shaft end 56 of the axle 50 so as to positively rotate therewith. Located between the disks 84 and 86 is an additional disk 88 which is not locked onto the shaft end 56 and is free to rotate thereabout. The outer edge of the disk 88 includes gear teeth 90 around the entire peripheral edge thereof so as to be in the form of a ratchet as shown more clearly in FIG. 4. Although FIG. 4 shows only three ratchet teeth, the teeth actually are arranged around the entire peripheral edge of the disk 88.

Located between the disks 84 and 88 is a friction brake pad 92. A similar friction brake pad 94 is located between the disks 86 and 88. A nut 96 is threaded onto the end of the shaft end 56 and is used to compress a spring washer 98 against the disk 86 so as to compress the sandwich formed by the disks 84, 86 and 88 and the friction brake pads 92 and 94. As a result, the disk 88 which would otherwise be free to rotate relative to the axle 50 will rotate with the axle 50 since it is engaged by the brake pads 92 and 94.

Surrounding the disks 84, 86 and 88 and the brake pads 92 and 94 is a cylindrical housing 100 that is fixedly secured to the outer surface of the side wall 42. An opening 102 is formed in the wall of the cylindrical housing 100 so as to make the gear teeth 90 of the disk 88 accessible of the outside thereof as shown in FIGS. 3 and 4. A pawl 104 is pivotally mounted to the outside surface of the wall 42 so as to pivot about its own pivot point 106. A spring 108 biases the pawl 104 inwardly through the opening 102 so as to engage the teeth 90 of the disk 88. A short manually operated lever 110 can be used to pivot the pawl 104 outwardly away from the gear teeth 90 against the force of the spring 108 when it is desired to disengage the pawl 104 from the teeth 90.

Figure 8:
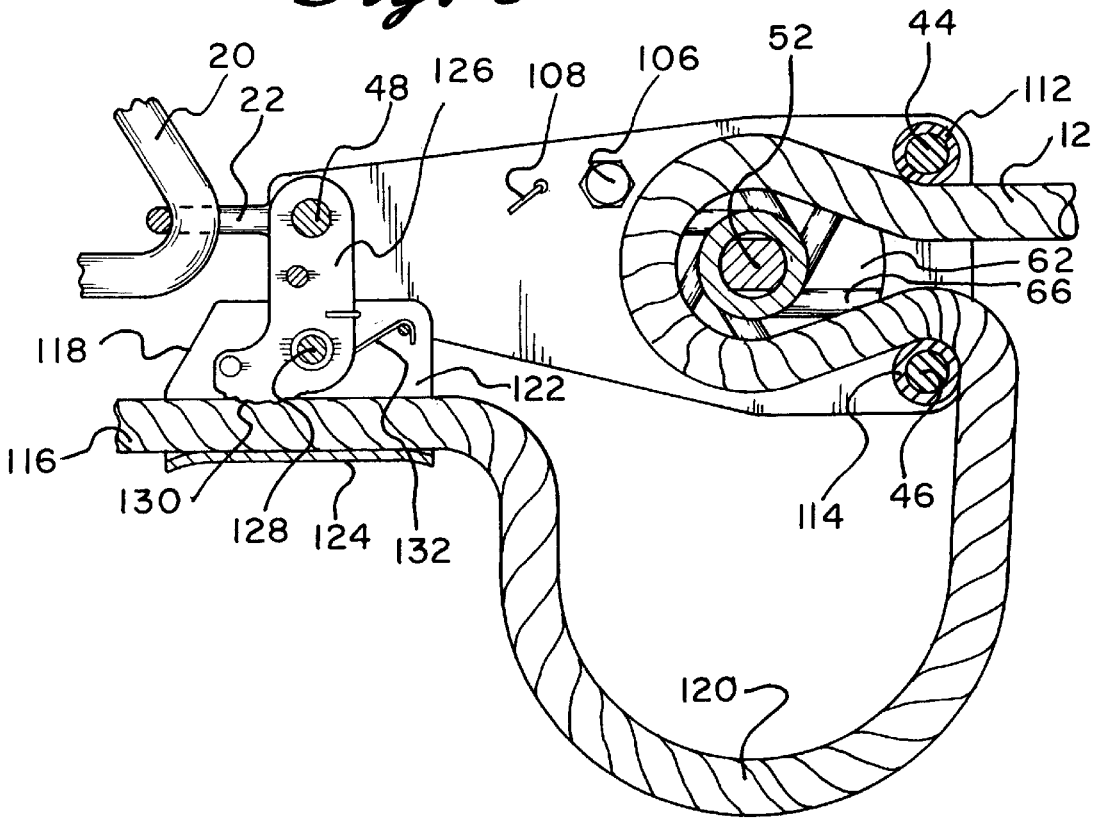
FIG. 8 is a cross sectional view illustrating an additional braking mechanism of the present invention.
Figure 9:
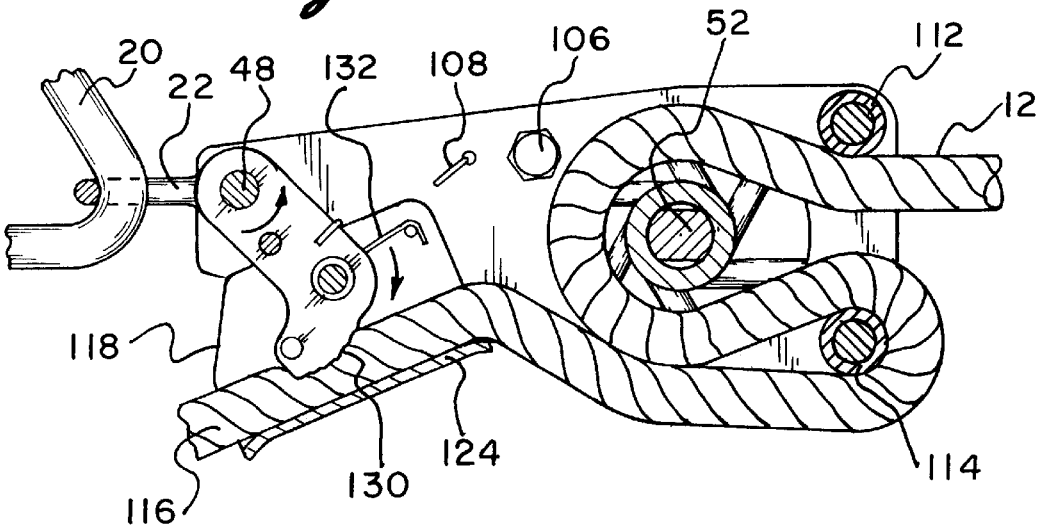
FIG. 9 is a view similar to FIG. 8 showing the additional braking mechanism in its operative braking condition.

FIGS. 8 and 9 illustrate how the lifeline 12 is arranged within the safety device 10 of the present invention. FIG. 8 shows a device when the lifeline 12 is in its normal operating condition. It can be seen that the lifeline 12 enters the end of the safety device 10 from the right as viewed in FIG. 8 and passes under the roller 112 which surrounds the bolt 44. The lifeline 12 then passes around the pulley 62 and out through the right side of the safety device 10 and downwardly around the roller 114 which surrounds the bolt 46. The free end 116 of the lifeline 12 then passes through a brake mechanism 118. Preferably, however, a small loop120 remains between the roller 114 and the brake mechanism 118.

The brake mechanism 118 is similar to that shown and described in U.S. Pat. No. 5,156,240. It includes a U-shaped housing 122 having two side walls and a bottom wall 124. A brake 126 is pivoted to the side walls of the U-shaped housing 122 through pivot 128 and includes a series of teeth 130 formed at the lower portion thereof. A spring 132 biases the teeth 130 downwardly so as to slightly compress the lifeline 12. The upper end of the brake lever 126 is pivoted to the main housing of the safety device 10 through the bolt 48. As shown most clearly in FIG. 9, should the lifeline 12 be pulled to the right beyond the braking force of the pulley 62 as will be explained in more detail below, the brake mechanism 118 will pivot counterclockwise or to the right as viewed in FIG. 9. The U-shaped housing 122 will then begin to pivot clockwise relative to the brake 126 forcing the teeth 138 into the lifeline 12 to force the same against the bottom wall 124 and thereby prevent any further withdrawal of the lifeline 12 from the safety device 10. That is, no further movement to the right will be allowed because of the braking mechanism 118. As final safety check, a knot 134 is tied in the end of the lifeline 12 so that, if all else fails, the lifeline 112 cannot fully disengage from the safety device 10.

The safety device 10 described above is utilized in the following manner. After the nuts 80 and 96 are tightened to their respective desired tensioning positions, the safety device 10 along with the horizontal lifeline 12 and the anchoring line 18 are arranged and assembled in essentially the position shown in FIG. 1. The lifeline 12 passes into the housing of the safety device 10, around the pulley 62 and through the brake mechanism 118 essentially in the manner shown in FIG. 8. Once in that position, the lifeline 112 can be pulled by hand to begin to tension the same since the pulley 62 is free to rotate counterclockwise as viewed in FIGS. 1 and 8 (clockwise as viewed in FIG. 4). The pulley 62 cannot, however, rotate in the reverse direction since the pawl 104 engages the teeth 90 of the disk 88.

Once the horizontal lifeline 12 is manually tightened by pulling the same through the safety device 10, it is properly tensioned by rotating the lever 30 counterclockwise as shown in FIG. 1. This can be done by either rotating the lever through 360° or by making small rotations and backing up in a ratchet like manner. Again, as the lifeline 12 is tensioned, it will remain under tension and will not loosen even though the force is removed from the lever 30 in view of the pawl 104 that engages the teeth 90 in the disk 88. Obviously, however, when the pulley 62 is being rotated by the lever 30 tensioning the lifeline 12, the pawl 104 is cammed out of the teeth 90 and engages the next tooth after the disk 88 stops rotating.

When the proper tension in the lifeline 12 is obtained as predetermined by the setting of the nut 80, the force applied to the lever 30 will exceed the braking force created by the brake pads 76 and 78. As a result, the disk 72 will rotate freely and will not further rotate the pulley 62. As pointed out above, a dial can be arranged at the end surface of the nut 80 with an indication thereon as to where the nut 80 must be rotated relative to the end of the shaft 54 so as to achieve any particular desired tension on the horizontal lifeline 12.

After the lifeline 12 is properly tensioned, the end 116 of the lifeline 12 is pulled through the brake mechanism 118 until the loop 120 remains as shown in FIG. 8. It should be readily apparent that the end 116 of the lifeline 12 can be easily pulled through the brake mechanism 118 from right to left as viewed in FIG. 8 since the brake only works in the reverse direction. The horizontal lifeline 12 can now be used in its normal manner.

In the event of a fall by a worker and a sudden increase in force on the lifeline 12, the pulley 62 will attempt to rotate clockwise as viewed in FIG. 8. This rotation will be resisted by the fact that the pawl 104 engages the teeth 90 in the disk 88. However, if the force caused by the falling worker on the lifeline 12 exceeds the braking force created by the brake pads 92 and 94, the pulley 62 will rotate even though disk 88 is fixed by the pawl 104. The amount and speed of rotate of the pulley 62, however, will be restricted because of the braking force of the brake pad 92 and 94. Thus, although the pulley 62 may rotate through a number of turns, it will do so relatively slowly thereby functioning as shock absorber. The amount and speed of this rotation can be preadjusted by tightening or loosening the nut 96.

After the shock absorber function of the safety device 10 does its job and the pulley 62 has rotated through a number of turns, the movement of the lifeline 12 will eventually stop as the loop 120 shown in FIG. 8 is taken up and drawn around the pulley 62 as shown in FIG. 9. At this point, the brake mechanism 118 will prevent further movement of the lifeline 12. Again, in the event that all else fails, the knot 134 at the end 116 of the lifeline 12 will prevent any further movement of the lifeline 12.

The present invention may be embodied in other specific forms without departing from the spirit or essential attributes thereof and accordingly reference should be made to the appended claims rather than to the foregoing specification as indicating the scope of the invention.

I claim:

1. A safety apparatus for use with a lifeline which lifeline is comprised of an elongated rope intended to be suspended between two fixed supports and placed under a predetermined amount of tension comprising:

a housing;

a pulley wheel rotatably mounted within said housing, said rope being adapted to extend into said housing and around said pulley wheel so that rotation of said pulley wheel in a first direction will cause said rope to come under tension;

handle means mechanically attached to said pulley wheel for manually rotating said pulley wheel to tension said rope when said handle means is moved so as to rotate said pulley wheel in said first direction;

means automatically allowing said handle means to move without rotating said pulley wheel when the tension in said rope reaches a predetermined level; and shock absorbing means carried by said housing, said shock absorbing means including friction braking means allowing limited and controlled rotation of said pulley wheel in a second direction when the tension on said lifeline exceeds a predetermined force.

2. The safety apparatus as claimed in claim 1 wherein said handle means includes a lever.

3. The safety apparatus as claimed in claim 1 further including means for adjusting said predetermined level.

4. The safety apparatus as claimed in claim 1 wherein said means for automatically allowing said handle means to move without rotating said pulley wheel when the tension in said rope reaches a predetermined level includes friction brake means.

5. The safety apparatus as claimed in claim 4 further including an axle, said pulley wheel and said friction brake means being mounted on said axle.

6. The safety apparatus as claimed in claim 5 wherein said pulley wheel is fixedly secured to said axle so as to rotate therewith.

7. The safety apparatus as claimed in claim 6 wherein said friction brake means is comprised of first and second disks coaxial with said axle, said first disk being secured to said axle for positive rotation therewith and said second disk being movable by said handle means.

8. The safety apparatus as claimed in claim 7 further including friction pad means located between said first and second disks.

9. The safety apparatus as claimed in claim 8 further including means for forcing said first and second disks and said friction pad means into contact with each other.

10. The safety apparatus as claimed in claim 1 further including means for adjusting said predetermined force.

* * * * *